US006272752B1

(12) United States Patent
Pino

(10) Patent No.: US 6,272,752 B1
(45) Date of Patent: Aug. 14, 2001

(54) HAIR TRIMMING TOOL

(76) Inventor: Robert F. Pino, 902 Barclay Tower, Cherry Hill, NJ (US) 08034

( * ) Notice: Subject to any disclaimer, the term of this patent is extended or adjusted under 35 U.S.C. 154(b) by 0 days.

(21) Appl. No.: 09/385,516

(22) Filed: Aug. 30, 1999

(51) Int. Cl.[7] ..... B26B 21/02
(52) U.S. Cl. ..... 30/29.5; 30/49
(58) Field of Search ..... 30/29.5, 346.57, 30/53–55, 49

(56) References Cited

U.S. PATENT DOCUMENTS

| | | | | |
|---|---|---|---|---|
| 1,229,824 | | 6/1917 | Tewelow . | |
| 1,522,298 | | 1/1925 | Goodrich . | |
| 3,299,507 | * | 1/1967 | Mistretta | 30/29.5 X |
| 4,571,827 | | 2/1986 | Lee | 30/29.5 |
| 4,958,432 | | 9/1990 | Marshall | 30/29.5 |
| 5,568,688 | | 10/1996 | Andrews | 30/29.5 |
| 5,655,301 | | 8/1997 | Dickson | 30/29.5 |

FOREIGN PATENT DOCUMENTS

286594 * 10/1952 (CH) ..... 30/49

* cited by examiner

*Primary Examiner*—Douglas D. Watts
(74) *Attorney, Agent, or Firm*—Norman E. Lehrer

(57) ABSTRACT

A hair trimming tool which includes an elongated handle with a first end and a second end, a blade member releasably mounted to the handle, a plurality of blades extending outwardly from the blade member, and an end cap secured to the blade member is disclosed. In order to use the tool the user inserts the tool into his ear, with the end cap fitting within the ear, and rotates the handle member. As a result of this action the blades contact the hair within the ear, thereby trimming the hair. The end cap protects the inside of the person's ear while the hair is being trimmed.

3 Claims, 2 Drawing Sheets

HAIR TRIMMING TOOL

BACKGROUND OF THE INVENTION

The present invention is directed toward a tool for trimming hair and more particularly, toward a razor for trimming hair from a person's ears.

It is a common practice to trim facial, nose, and ear hair for either aesthetic or health reasons. Scissors, clippers, razors, and the like are some of the devices used for this practice.

Some of the tools for trimming or removing unwanted facial, nose, and ear hair are described in the following patents. U.S. Pat. No. 1,229,824 to Tewelow discloses a cutter for removing hair from cavities. This patent discloses a tool with a handle and blades where the handle is revolved back and forth so that hair is cut. This tool, however, does not adequately protect the user. That is, injury to the cavity within which the tool is inserted may occur.

U.S. Pat. No. 1,522,298 to Goodrich discloses a safety razor with a handle and a razor located on the side of the handle. The handle is rotated in order to trim hair from the nose or ear. The end of the handle which is inserted into the nose or ear is rounded so that injury does not occur as the handle is rotated. This razor, however, is not efficient in trimming hair because the blade is located on only one side of the handle.

U.S. Pat. No. 5,655,301 to Dickson discloses a rotary hair trimmer with a handle and a plurality of blades located at an end of the handle. This trimmer, however, does not have a protective end which would prevent injury to a person using the trimmer.

U.S. Pat. No. 5,568,688 discloses a manually operated hair trimming device with a curved razor blade strip which may be used to trim hair from the ears or the nose. The blade is located at an end of the device so that the edges of the blade are exposed in such a manner that the person using the device may injury himself.

U.S. Pat. No. 4,958,432 to Marshall discloses a rotary hair trimmer which includes a housing with an internal rotary electric motor and a cutting head having a plurality of arcuate segment blades. This device, however, does not provide adequate protection for the user against inadvertent cuts and nicks in the skin.

SUMMARY OF THE INVENTION

The present invention is designed to overcome the deficiencies of the prior art discussed above. It is an object of the present invention to provide a tool for trimming hair which is easy and safe to use.

It is a further object of the present invention to provide a razor which can be used to trim unwanted hair from a person's ears.

In accordance with the illustrative embodiments demonstrating features and advantages of the present invention, there is provided a hair trimming tool which includes an elongated handle with a first end and a second end, a blade member releasably mounted to the handle, a plurality of blades extending outwardly from the blade member, and an end cap secured to the blade member. In order to use the tool the user inserts the tool into his ear, with the end cap fitting within the ear, and rotates the handle member. As a result of this action the blades contact the hair within the ear, thereby trimming the hair. The end cap protects the inside of the person's ear while the hair is being trimmed.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 2:
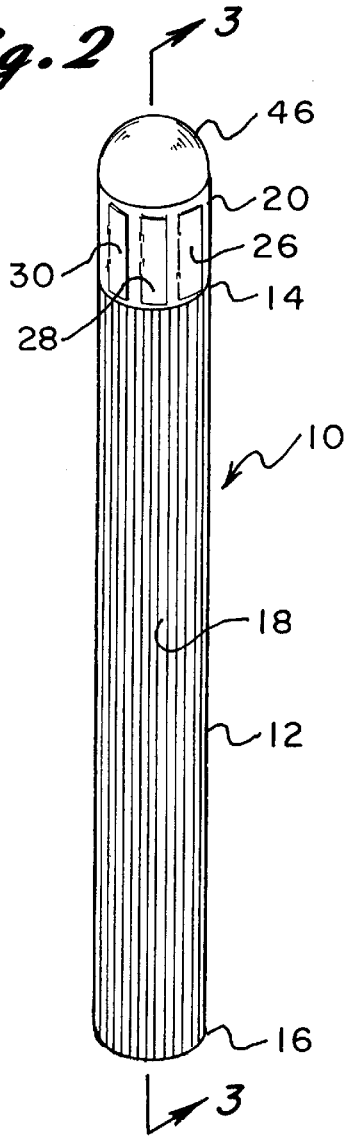
FIG. 2 is a perspective view of the hair trimming tool of the present invention.

Referring now to the drawings in detail wherein like reference numerals have been used throughout the various figures to designate like elements, there is shown in FIG. 2 a trimming tool constructed in accordance with the principles of the present invention and designated generally as 10.

The trimming tool of the present invention essentially includes an elongated generally cylindrical handle member 12 having a first end 14 and a second end 16. The handle member 12 may have gripping means 18 in order to improve the user's grip on the tool. For example, FIG. 2 shows a knurled handle member. Located adjacent to the first end 14 and substantially coaxial with the handle member is a generally cylindrical blade member 20 with a top end 22 and a bottom end 24. A plurality of blades 26, 28, 30, 32, 34, 36, 38, and 40 are mounted to the outer surface of the blade member 20 and are spaced apart from each other. The blades 26, 28, 30, 32, 34, 38, and 40 are oriented in such manner so that a cutting edge of each of the blades extends outwardly at a slight angle from the blade member 20 substantially tangentially to the outer surface of the blade member 20. That is, the tool may be rotated in only one direction in order to provide a cutting or trimming effect as will be discussed in greater detail below.

Figure 4:
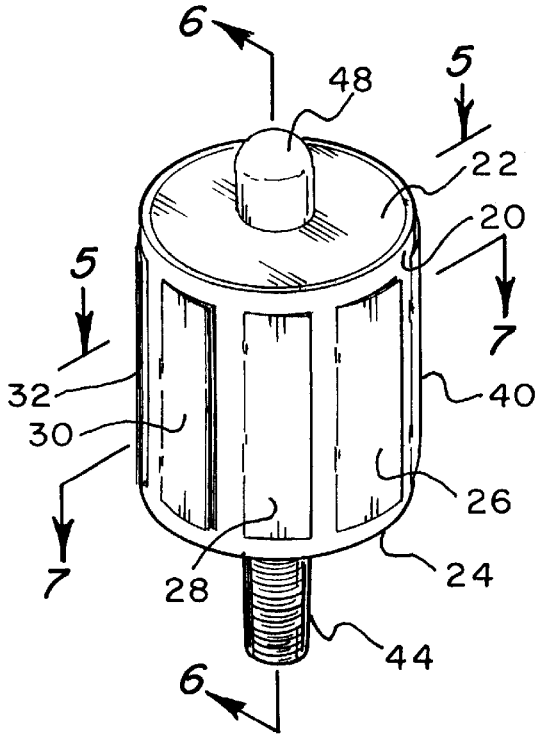
FIG. 4 is a perspective view of the blade member of the hair trimming tool of the present invention.
Figure 5:
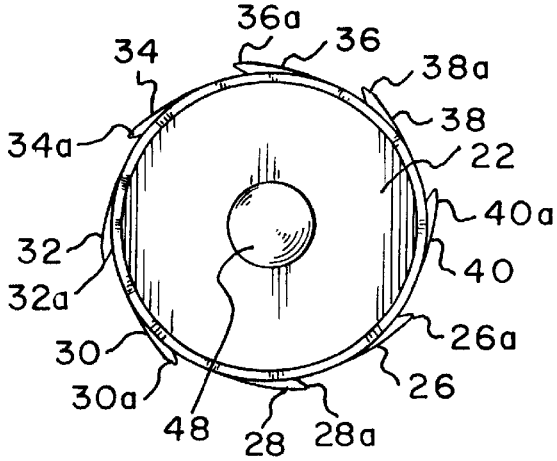
FIG. 5 is a cross-sectional view taken through line 5—5 of FIG. 4.
Figure 6:
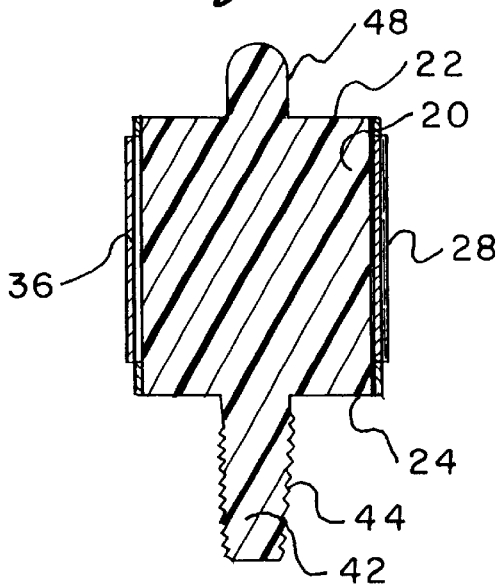
FIG. 6 is a cross-sectional view taken through line 6—6 of FIG. 4.

The bottom end 24 of the blade member 20 may have a protrusion 42 extending therefrom having means for releasably mounting or attaching the blade member 20 to the handle member 12. The means for releasably attaching may be screw threads 44 located on protrusion 42 which matingly engage with threads within a socket of the handle member as seen in FIG. 4. In this manner, the blade member 20 may be easily detached from the handle member 12 so that the blade member 20 may be replaced.

Figure 3:
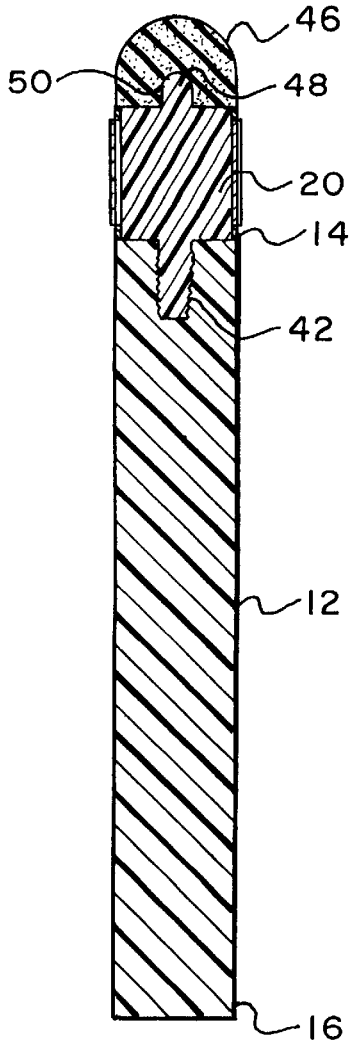
FIG. 3 is a cross-sectional view taken through line 3—3 of FIG. 2.

Attached to the top end 22 of the blade member 20 is an end cap 46. Means for securing the end cap 46 to the blade member 20 is shown in FIG. 3, for example, as being a projection 48 located on the top end 22 of the blade member 20 and a notch 50 located within the end cap 46 into which the projection 48 fits frictionally so that the end cap 46 is secured to the blade member 20. While the securing means is shown as a projection and notch, it should be realized that any type of securing means may be used. Alternatively, the end cap, blade member, and handle member may be formed as one piece. That is, the end cap and blade member need not be removable from the handle member.

Figure 1:
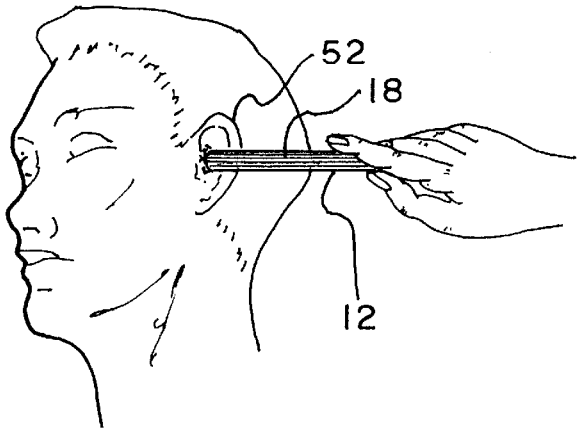
FIG. 1 is schematic representation of a person using the hair trimming tool of the present invention.
Figure 7:
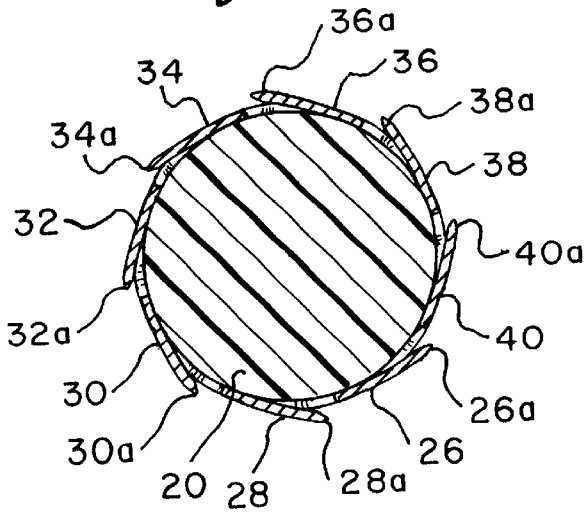
FIG. 7 is a cross-sectional view taken through line 7—7 of FIG. 4.

In order to use the trimming tool of the present invention, a person simply grips the handle member 12 adjacent to the second end 16. The user may, however, grip the handle member 12 wherever it is comfortable for the user to do so. The tool is then inserted into the user's ear 52 with the end cap 46 being placed within the ear 52 in order to provide protection to the user. (See FIG. 1.) The user rotates the tool clockwise so that the blades cut the hair located within the ear. The orientation of the blades is such that as the tool is rotated in the clockwise direction, the edges 26*a*, 28*a*, 30*a*, 32*a*, 34*a*, 36*a*, 38*a*, and 40*a* of the blades 26, 28, 30, 32, 34, 38, and 40, respectively, successively trim hair. That is, only one cutting edge of each of the blades extends slightly outwardly from the blade member. (See FIG. 7.) Therefore, if the tool is rotated in an opposite or counterclockwise direction, the extended edge of each of the blades will merely slide past the hair without cutting the hair.

The present invention may be embodied in other specific forms without departing from the spirit or essential attributes thereof and accordingly, reference should be made to the appended claims rather than to the foregoing specification as indicating the scope of the invention.

I claim:

1. A hair trimming tool comprising:

an elongated substantially cylindrically shaped handle member;

a generally cylindrically shaped blade member with a top end and a bottom end;

means for releasably mounting said blade member to said handle member so as to be coaxial therewith;

a plurality of blades extending outwardly from said blade member wherein each of said plurality of blades has a cutting edge which extends outwardly at a slight angle from said blade member substantially tangentially to an outer surface of said blade member so that a trimming effect results only when said handle is rotated in one direction; and an end cap secured to said top end of said blade member.

2. The hair trimming tool of claim 1 wherein said releasably mounting means includes screw threads.

3. The hair trimming tool of claim 1 wherein said handle member has gripping means located thereon.

* * * * *